US005481997A

United States Patent [19]

Arndt

[11] Patent Number: 5,481,997

[45] Date of Patent: Jan. 9, 1996

[54] WATER JET PROPELLED KAYAK

[76] Inventor: Raymond U. Arndt, P.O. Box 84243, San Diego, Calif. 92138

[21] Appl. No.: 223,709

[22] Filed: Apr. 26, 1994

[51] Int. Cl.[6] ..... B63B 35/00

[52] U.S. Cl. ..... 114/347; 440/42; 114/153

[58] Field of Search ..... 114/343, 153, 114/347, 364, 151, 153; 440/38, 39, 40, 41, 42, 7

[56] References Cited

U.S. PATENT DOCUMENTS

| | | | |
|---|---|---|---|
| 3,082,732 | 3/1963 | Stallman . | |
| 3,369,518 | 2/1968 | Jacobson | 440/38 |
| 3,750,614 | 8/1973 | Giacosa . | |
| 3,797,447 | 3/1974 | Stubblefield . | |
| 3,834,342 | 9/1974 | Schoell . | |
| 3,893,405 | 7/1975 | Lais et al. . | |
| 3,906,886 | 9/1975 | Elger . | |
| 3,911,846 | 10/1975 | England . | |
| 3,943,876 | 3/1976 | Kiekhaefer . | |
| 4,047,494 | 9/1977 | Scott . | |
| 4,229,850 | 10/1980 | Arcouette | 114/347 |
| 4,690,649 | 9/1987 | Zeimet | 114/347 |
| 4,943,251 | 7/1990 | Lerach et al. | 114/347 |
| 4,964,821 | 10/1990 | Tafoya | 440/38 |
| 5,076,185 | 12/1991 | Tarng | 114/39.2 |
| 5,151,057 | 9/1992 | Kobayashi et al. | 440/38 |
| 5,209,683 | 5/1993 | Imaeda et al. | 440/38 |

*Primary Examiner*—Stephen Avila
*Attorney, Agent, or Firm*—Thomas J. Tighe

[57] ABSTRACT

A kayak having a kayak-style hull with one or more cockpits, and an inboard power device that accelerates water and directs it out a steerable stern nozzle. In the embodiment described, an internal combustion engine drives a water impeller that receives water from an intake communicating with a body of water on which the kayak is located. The stern nozzle laterally redirects the accelerated water from the impeller over an angular range centered on a long axis of the hull. The operator controls the angle of the stern nozzle by means of a foot pedal accessible to an operator in the cockpit. The kayak also has a foot pedal for controlling a throttle of the engine.

18 Claims, 2 Drawing Sheets

WATER JET PROPELLED KAYAK

BACKGROUND OF THE INVENTION

This invention relates in general to small boats propelled by the forceful expulsion of water from a nozzle, and in particular to kayaks and kayak-like boats so propelled.

A kayak is a small double-ended boat generally having a displacement hull and a light framework covered by skin or skin-like material, and particularly adapted for white-water boating. Some kayaks are made watertight by a flexible enclosure around the waist of an occupant. As used herein the term "kayak" shall refer to and mean traditional kayaks, more modern sporting kayaks, and kayak-like boats.

Kayaks are conventionally propelled manually by a double-ended paddle which is generally an adequate means of propulsion when going downstream, but not so adequate when going upstream. Traditionally kayaks are transported upstream over land and used only for downstream water journeys. Paddling upstream for any significant distance is avoided because of the work and time involved.

This invention provides propulsion to a kayak to enable an operator to travel upstream for long distances and then head downstream under power or not. The operator can start "up stream" from a convenient launch area, go upstream as far as possible under jet power, and then turn downstream under power or without power. With a choice of operating the kayak under power or manually, the operator can go back and forth, up and down stream, in mild to heavy currents, and from lake to white water conditions.

An operator can use a jet kayak according to this invention in white water conditions because it still has a low center of gravity which is an advantageous kayak characteristic that has been proven over centuries with traditional non-power kayaks. Moreover the same stretch of white water can be re-run indefinitely without hauling the craft over land because of its capability to go upstream under power. Thus by re-runs an operator can travel the same amount of white water in a short distance from a launching area as would otherwise require transporting the kayak to long white water runs, normally in wilderness areas.

Even though many variations of "jet skis" and "wave runners" have evolved from the original jet ski designs, a jet kayak according to this invention has a significant advantage over them in that it gives the operator the necessary stability to negotiate the craft in white water conditions.

Other advantages and attributes of this invention will be readily discernable upon a reading of the text hereinafter.

SUMMARY OF THE INVENTION

An object of this invention is to provide a water jet propelled kayak.

A further object of this invention is to provide a kayak that can be used and enjoyed as are conventional kayaks, but that has an inboard engine driving a water impeller for propulsion, particularly for upstream propulsion.

A further object of this invention is to provide a water jet propelled kayak that can be steered, when under power, by manipulation of a foot control, e.g. a foot pedal.

These objects, and other objects expressed or implied in this document, are accomplished by a kayak having: (a) a kayak style hull defining an operator's cockpit and having a stern, (b) an engine driving a water impeller for accelerating water sternward (toward the stern), both in a watertight compartment aft of the cockpit, (c) a water intake communicating with a body of water on which the kayak is located for providing water to the water impeller, (d) a stern nozzle at least partially below the water level of the body of water for laterally redirecting the accelerated water over an angular range centered on a long axis of the hull, and a foot pedal accessible to an operator in the cockpit for selectively controlling the angular position, within the angular range, of the stern nozzle. The kayak also has a foot pedal for controlling a throttle of the engine.

DESCRIPTION OF THE PREFERRED EMBODIMENT

Figure 1:
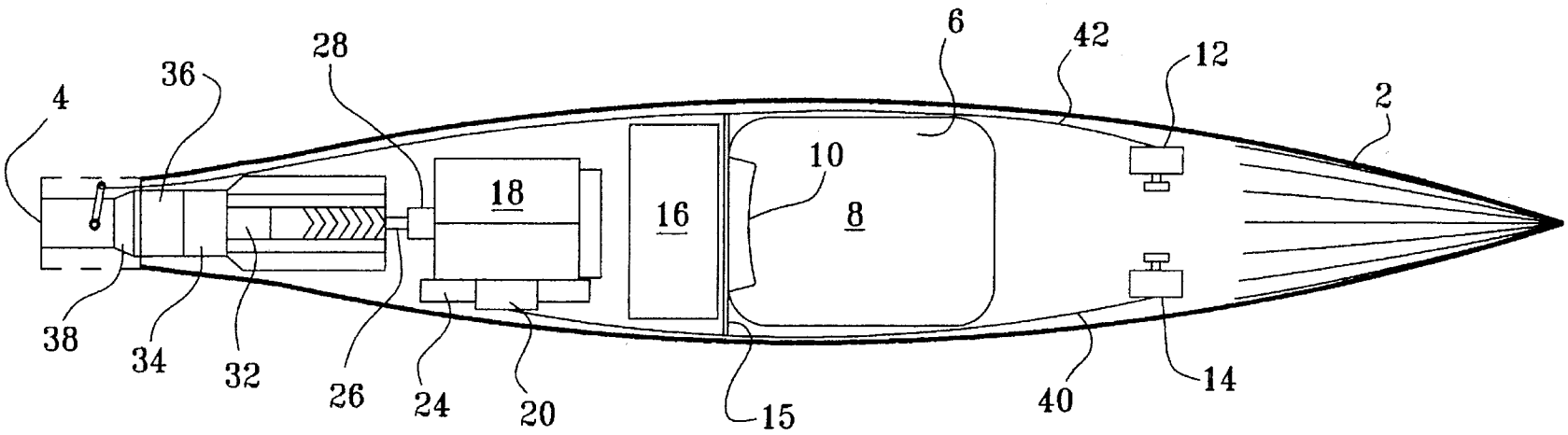
FIG. 1 is a plan view of a water jet propelled kayak according to this invention with portions of the hull cut away to show the propulsion system.
Figure 2:
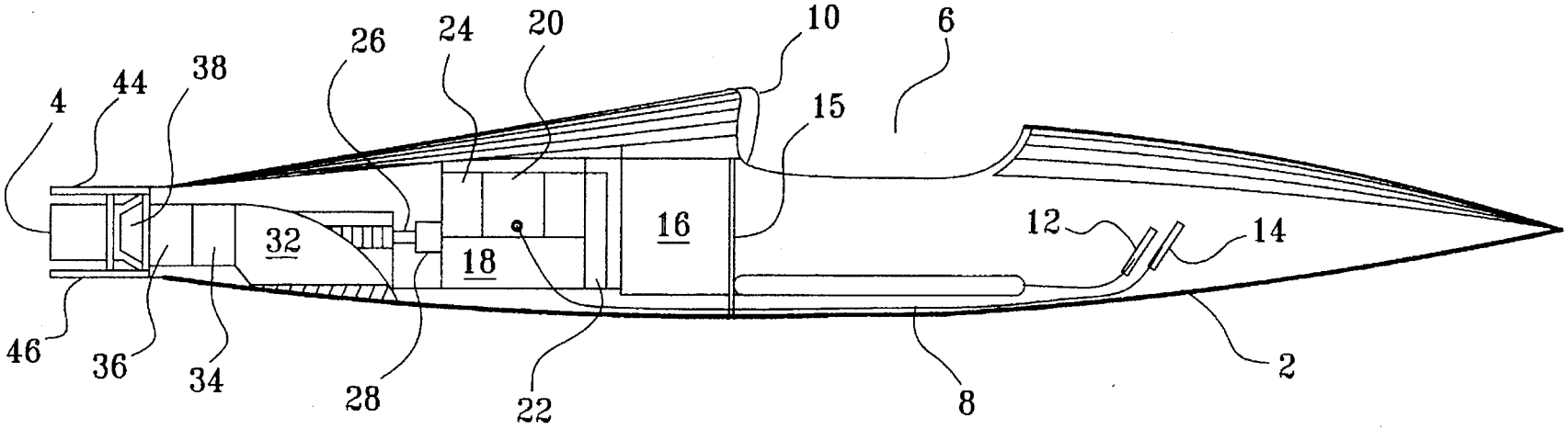
FIG. 2 is a side elevational view of the kayak of FIG. 1, again with portions of the hull cut away to show the propulsion system.

Referring to FIGS. 1 and 2, an illustrated kayak has a hull 2 of generally traditional kayak form except for a water jet nozzle 4 at its stern. It has a cockpit 6 with a cushion 8 and backrest 10. As illustrated the cockpit accommodates one operator, but it can be built for a two person operation. The flexible enclosure for making the cockpit watertight is not shown for clarity. When under power, the operator can control the kayak by use of two control pedals—a steering pedal 12 and a throttle pedal 14. The operator can also use a kayak paddle in combination with the pedal controls for more precise maneuvering.

Referring again to FIGS. 1 and 2, immediately aft of the cockpit is a water-tight compartment separated from the cockpit by a bulkhead that serves also as a firewall. Within the compartment is a fuel tank 16 and immediately aft of the fuel tank is a power plant. The power plant includes an engine 18, a carburetor 20, an ignition system 22, and an exhaust and water box 24. The engine is preferably a two-stroke, internal combustion engine having at least two cylinders. The engine turns a drive shaft 26, through a coupling 28, which in turn transfers rotational power to an impeller in an impeller housing 34. The coupling can be direct drive or can incorporate a torque converter. The impeller receives water via a water intake duct 32 and accelerates the water and communicates it through an impeller duct 36 to a funneling jet nozzle 38. The water is further accelerated as it is funneled by the jet nozzle to the stern nozzle 4 which is a steering nozzle. The high velocity water leaving the steering nozzle propels the kayak in reaction.

Referring again to FIGS. 1 and 2, the throttle pedal 14 is linked to the carburetor 20 via a first control cable 40. The steering pedal 12 is linked to the steering nozzle 4 via second control cable 42. Preferably these are "Morse" type cables. The steering nozzle is preferably protected from impact by foreign objects by top and bottom running plates, 44 and 46. The steering nozzle is, however, free to rotate laterally in either direction within an angular range under control of the steering pedal. As previously mentioned, steering of the kayak under power can be by a combination of the steering pedal and a traditional kayak paddle. This gives the operator much more positive maneuvering control than either one alone. Also, the throttle pedal can be used for additional steering and maneuvering control. In this way an operator has three positive maneuvering tools rather than just the paddle as with non-powered kayaks. This positive control combination makes white-water kayaking much safer because obstacles, such as rocks, can be more easily avoided.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, this invention is also well suited for the "sit on" style of kayak hulls, such as those used for kayaks that are also commonly known as "seagoing" kayaks.

I claim:

1. A powered kayak comprising:

(a) a kayak-style hull defining an operator's cockpit and having a stern, (b) means, disposed within the hull aft of the cockpit, for accelerating water sternward, (c) intake means, communicating with a body of water on which the kayak is located, for providing water to the means for accelerating water, (d) means, at the stern of the hull and at least partially below the water level of the body of water, for laterally redirecting the accelerated water over an angular range centered on a long axis of the hull, and (f) means, accessible to an operator in the cockpit, for selectively controlling the angular position within said angular range of the means for redirecting the accelerated water.

2. The kayak according to claim 1 wherein the hull is a displacement hull.

3. The kayak according to claim 1 wherein the hull is a double-ended displacement hull.

4. The kayak according to claim 1 further comprising:

(a) impeller means, disposed in the hull forward of the stern, for accelerating the water to the means for redirecting the water, (b) a fuel consuming engine disposed in the hull for turning the impeller means, (c) a fuel supply disposed in the hull, and (d) throttle means, accessible to an operator in the cockpit, for regulating the flow of fuel from the supply to the engine.

5. The kayak according to claim 4 wherein the hull is a displacement hull.

6. The kayak according to claim 4 wherein the hull is a double-ended displacement hull.

7. The kayak according to claim 1 further comprising at least one protective plate for shielding the means for redirecting the accelerated water.

8. The kayak according to claim 4 further comprising at least one protective plate for shielding the means for redirecting the accelerated water.

9. The kayak according to claim 1 further comprising means for operating the means for selectively controlling the angular position by foot.

10. The kayak according to claim 1 further comprising further comprising foot pedal means for selectively controlling the angular position by foot.

11. The kayak according to claim 4 further comprising means for operating the throttle means by foot.

12. The kayak according to claim 4 further comprising foot pedal means for operating the throttle means.

13. The kayak according to claim 9 further comprising means for operating the throttle means by foot.

14. The kayak according to claim 10 further comprising means for operating the throttle means by foot.

15. The kayak according to claim 1 further comprising a watertight compartment means in which the means for accelerating water sternward is disposed.

16. The kayak according to claim 15 wherein the watertight compartment is defined by the hull, an aft deck and a bulkhead extending between the aft deck and the hull.

17. The kayak according to claim 4 further comprising a watertight compartment means in which the engine is disposed.

18. The kayak according to claim 17 wherein the watertight compartment is defined by the hull, an aft deck and a bulkhead extending between the aft deck and the hull.

* * * * *